US005916349A

United States Patent [19]

Czabala

[11] Patent Number: 5,916,349

[45] Date of Patent: Jun. 29, 1999

[54] PISTON ASSEMBLY AND METHOD FOR REDUCING THE TEMPERATURE OF A COMPRESSOR CUP SEAL

[76] Inventor: Michael P. Czabala, 6090 Foxberry La., Roswell, Ga. 30075

[21] Appl. No.: 08/975,305

[22] Filed: Nov. 20, 1997

[51] Int. Cl.[6] ..... F01B 31/08

[52] U.S. Cl. ..... 92/144; 92/245; 417/313

[58] Field of Search ..... 92/144, 240, 245; 417/571, 313

[56] References Cited

U.S. PATENT DOCUMENTS

| | | | |
|---|---|---|---|
| 3,996,913 | 12/1976 | Hamparian | 92/144 X |
| 4,172,363 | 10/1979 | Bex | 92/144 X |
| 4,250,953 | 2/1981 | Bush | 92/144 X |
| 4,516,481 | 5/1985 | Geffroy et al. | 92/240 X |
| 4,536,132 | 8/1985 | Tenney | 92/144 X |
| 4,601,235 | 7/1986 | Roberts | 92/245 |
| 4,701,114 | 10/1987 | Andersen et al. | 92/144 X |
| 4,831,828 | 5/1989 | Klusmier et al. | 92/144 X |
| 5,064,359 | 11/1991 | Plummer | 92/240 X |

*Primary Examiner*—Hoang Nguyen
*Attorney, Agent, or Firm*—Gerald R. Boss; Troutman Sanders LLP

[57] ABSTRACT

A piston assembly comprising a piston sleeve having an interior wall, a piston carried in the piston sleeve, a cup seal carried by the piston which engages the interior wall of the piston sleeve, and a valve plate matingly adapted to receive the piston sleeve. A firm thermal-insulating barrier is disposed between the valve plate and the piston sleeve for reducing the heat flow from the valve plate to the piston sleeve.

12 Claims, 3 Drawing Sheets

PISTON ASSEMBLY AND METHOD FOR REDUCING THE TEMPERATURE OF A COMPRESSOR CUP SEAL

BACKGROUND OF THE INVENTION

This invention generally relates to a piston assembly for a standard compressor, and more particularly to a piston assembly with a hard joint having a thermal-insulating barrier for reducing the temperature of the piston sleeve and the cup seal of the compressor hence increasing the life of the cup seal and the compressor.

A typical piston assembly consists of a compressor head connected to a valve plate; a piston sleeve connected to the valve plate and pressure sealed with the valve plate by an o-ring; and a piston which travels inside the piston sleeve. The cup seal, which extends from the midsection of the piston, frictionally engages the interior of the piston sleeve in order to provide a seal between the pressurized and non-pressurized sides of the piston. The cup seal flexes during the upstroke and downstroke of the piston and the frictional engagement creates wear along the cup seal. The act of compression generates heat in the compressor head, which conducts from the compressor head to the piston sleeve via the valve plate. Heat then conducts from the piston sleeve to the cup seal which further hastens failure of the flexible cup seal, limiting the life of the compressor. Reduction of the temperature of the cup seal extends its life, and ultimately extends the life of the compressor.

The valve plate and the piston sleeve connect on the pressurized side of the piston, so a pressure seal must be formed between them to prevent gas leaks. This pressure seal is generally formed between the valve plate and the piston sleeve by an o-ring, which is typically made out of a flexible material. The o-ring is not intended to inhibit heat conduction from the compressor head through the valve plate to the piston sleeve, but merely provides a pressurized seal.

In certain piston assembly designs known as a soft joint assembly, the o-ring, which forms the pressure seal between the valve plate and the piston sleeve, is seated in a groove in the valve plate and the top face of the piston sleeve contacts the o-ring. The contact between the piston sleeve and the o-ring, and the valve plate and the o-ring, are unstable due to the mating of the flat surfaces of the valve plate and piston sleeve with the flexible, round surface of the o-ring. Additionally movement of the piston also causes metal-to-metal contact between the valve plate and the piston sleeve, allowing heat conduction from the compressor head through the valve plate to the piston sleeve. Furthermore, with a soft joint assembly, the clearance volume between the top of the piston and the valve plate when the top of the piston is at dead center fluctuates due to the compressionable nature of the o-ring which effects the compressor's efficiency. While the compressionable nature of the o-ring effects the compressor's efficiency, the compressability is required to ensure a pressure seal between the piston sleeve and valve plate.

In another piston assembly design known as a hard joint assembly, the piston sleeve is seated directly into a groove in the valve plate, creating a metal-to-metal contact point. In this design, the o-ring is located on the outer surface of the piston sleeve to create the pressure seal with the valve plate. An advantage of the hard joint assembly is the fixed clearance volume between the top of the piston and the valve plate when the piston is at top dead center. Since no o-ring is in the assembly, it is easy to control the clearance volume and the repeatability of the compressors' efficiency can be had by controlling the height of the piston sleeve and the clearance volume. However, heat is readily conducted through the metal-to-metal contact of the piston sleeve and the valve plate, resulting in heating of the piston sleeve and ultimately heating and failure of the cup seal.

Thus the known standard compressor piston assembly designs do not inhibit heat flow from the valve plate to the piston sleeve and provide for consistent compressor performance.

Accordingly, it is an object of the present invention to reduce the temperature of the piston sleeve caused by heat conduction from the compressor head through the valve plate to the piston sleeve;

Furthermore it is an object of the present invention to reduce the temperature of the piston sleeve by providing a thermal-insulating barrier between the valve plate and the piston sleeve;

Additionally it is an object of the present invention to provide a durable piston assembly containing a hard joint seal between the valve plate and the piston sleeve having a thermal-insulating barrier between the valve plate and the piston sleeve;

Furthermore it is an object of the invention to reduce the temperature of a piston sleeve by forced air convective cooling.

SUMMARY OF THE INVENTION

The above objectives are accomplished according to the present invention by providing a piston assembly comprising a piston sleeve having an interior wall, a piston carried in the piston sleeve, a cup seal carried by the piston which engages the interior wall of the piston sleeve, and a valve plate matingly adapted to rigidly receive the piston sleeve. A firm thermal-insulating barrier is disposed between the valve plate and the piston sleeve for reducing the heat flow from the valve plate to the piston sleeve.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
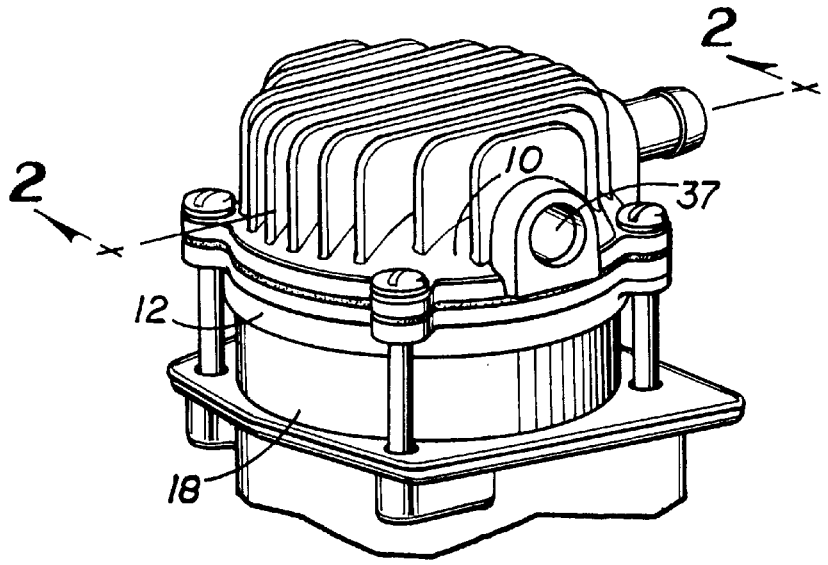
FIG. 1 is a perspective view of a standard compressor assembly housing a piston assembly according to the present invention.

Referring now to the drawings, the invention will be described in more detail.

Figure 2:
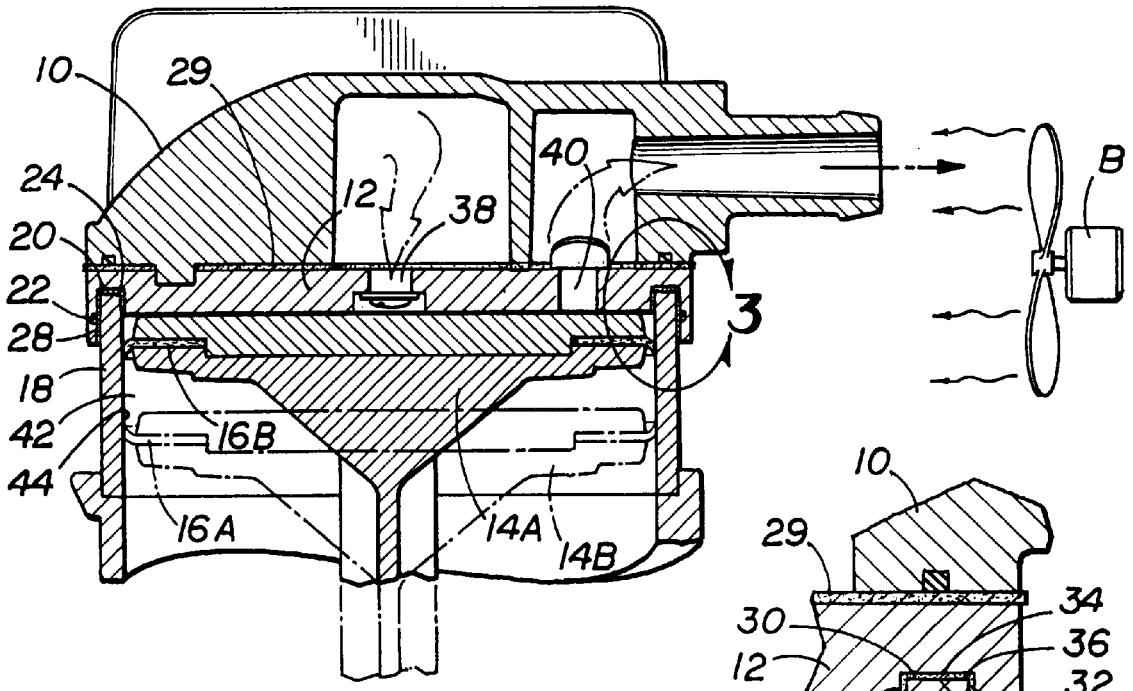
FIG. 2 is a sectional view taken along line 2—2 of FIG. 1 illustrating a piston assembly, the upstroke and downstroke positions of the piston, and a thermal-insulating barrier according to the present invention.

Referring now to FIG. 1 and FIG. 2, a standard compressor assembly (not shown) includes a piston assembly, designated generally as A. Piston assembly A includes compressor head 10, valve plate 12, piston sleeve 18 and gas intake port 37. As further illustrated in FIG. 2, piston assembly A further includes gas intake valve 38 and gas exit valve 40 disposed within compressor head 10 for allowing gas to enter and exit inner chamber of piston sleeve 42. Valve plate 12 has a valve plate groove 24 for receiving piston sleeve 18. Valve plate 12 and piston sleeve 18 are pressure sealed by o-ring 22. Cup seal 16 is attached to piston 14 which engages interior wall of piston sleeve 44 for sealing between the pressurized and non-pressurized sides of inner chamber of piston sleeve 42. Thermal-insulating barrier 20 is disposed between valve plate 12 and piston sleeve 18 for reducing heat flow from valve plate 12 and piston sleeve 18, and will be described more in detail in reference to FIG. 3. Thermal-insulating 20 barrier can be Teflon®, or a ceramic material or other material which is capable of having a flat cross-section and having low thermal-conductivity properties. Forced air circulator B blows air onto piston assembly A to provide convective cooling, further reducing the temperature of piston sleeve 18.

As fully shown in FIG. 2, gas enters inner chamber of piston sleeve 42 through intake valve 38, which is compressed by piston 14 in inner chamber of piston sleeve 42 and then released through outlet valve 40. Downstroke and upstroke positions of piston 14 are illustrated as 14*a* and 14*b*. Cup seal 16 engages interior wall of piston sleeve 44 to form a seal between the pressurized and the non-pressurized sides of inner chamber of piston sleeve 42. Due to its flexible nature, cup seal 16 adopts an upwardly flexed position 16*a* at the engagement point of interior wall of piston sleeve 44 when piston is in the downstroke position 14*b*, and adopts a downwardly flexed position 16*a* at the engagement point of interior wall of piston sleeve 44 while piston is in the upstroke position 14*a*. The engagement point of cup seal 16 and interior wall of piston sleeve 44 is the point of heat conduction to cup seal 16. To reduce heat flow to piston sleeve 18 and ultimately cup seal 16, thermal-insulating barrier 20 is engaged by piston sleeve 18 in valve plate groove 24.

Figure 3:
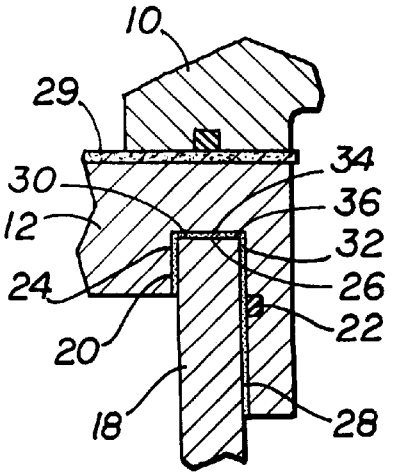
FIG. 3 is a detailed view of the area indicated in FIG. 2 illustrating the piston sleeve engaging the thermal-insulating barrier in the groove of the valve plate according to the present invention.

As shown in FIG. 3, piston sleeve 18 is matingly received by valve plate groove 24. The top surface and sides of piston sleeve 18 rest flush within valve plate groove 24. Valve plate groove 24 includes lateral sides 32 and flat top surface 30. Piston sleeve 18 includes outer surface 28, inner surface 29 and flat top surface 26. Piston sleeve 18 is rigidly received within valve plate groove 24 such that the piston sleeve is supported on all sides to prevent vibration. The rigid connection between piston sleeve 18 and valve plate groove 24 is known in the industry as a hard joint since the clearance between the piston sleeve and valve plate is fixed. Disposed between valve plate groove 24 and piston sleeve 18 is thermal-insulating barrier 20. Thermal-insulating barrier 20 is carried by valve plate groove 24 and includes a flat profile for abutting piston sleeve 18. Furthermore, the flat profile of thermal-insulating barrier 20 facilitates the rigid support of piston sleeve 18 within valve plate groove 24 for securing piston sleeve 18 within valve plate groove 24. In the preferred embodiment, thermal-insulating barrier 20 provides for a continuous insulating layer around piston sleeve 18 preventing metal-to-metal contact between piston sleeve 18 and valve plate groove 24. Valve plate 12 and piston sleeve 18 are pressure sealed by o-ring 22 disposed between outer surface of piston sleeve 28 and valve plate 12.

Also shown in FIG. 2, is the inclusion of a second thermal-insulating barrier 29 which is disposed between valve plate 12 and the compressor head 10 for further reducing the heat transfer from the compressor head to the piston sleeve.

In the preferred embodiment, thermal-insulating barrier 20 is made of a material which will lie flat within valve plate groove 24 thereby facilitating in the hard joint assembly of piston sleeve 18 within valve plate groove 24. Furthermore, thermal-insulating barrier 20 is made from a firm and generally non-resilient material to facilitate in the hard joint assembly. As previously mentioned, the hard joint assembly is such that the clearance volume between the top of the piston and the dead center of the valve plate is generally a fixed distance. Accordingly, the material of which thermal-insulating barrier 20 is made must be generally non-resilient. In the preferred embodiment, thermal-insulating barrier 20 is made of ceramic, but the material may also be Teflon® or the like which is effective in reducing the temperature of the piston sleeve by five percent between the situation wherein the piston assembly includes a thermal-insulating barrier versus a piston assembly lacking a thermal-insulating barrier. In the preferred embodiment, thermal insulating barrier 20 has thermal conductivity properties less than 0.1 watt/m° K.

Figure 4:
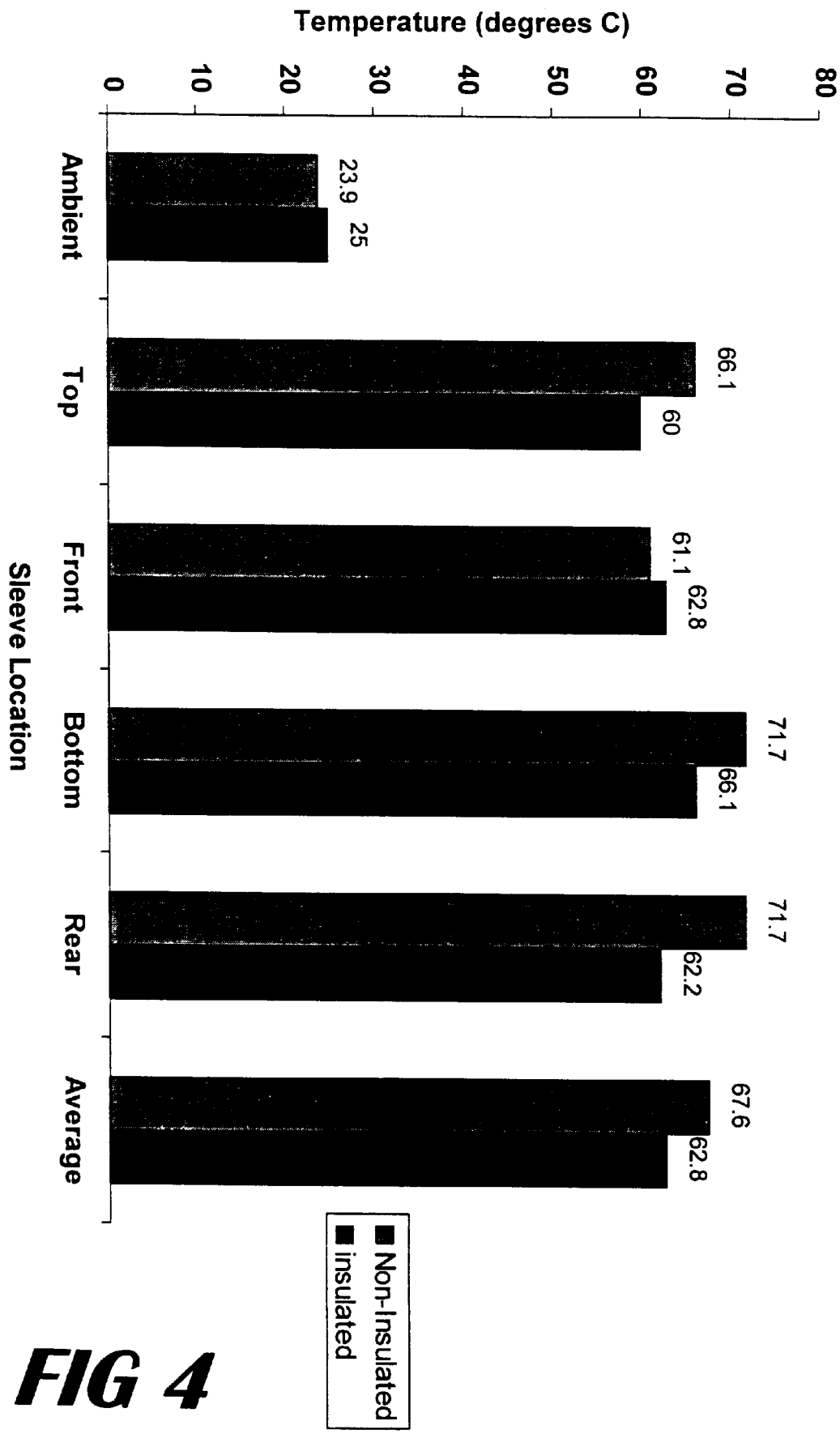
FIG. 4 is a chart illustrating the recorded temperature of a piston sleeve when insulated from a valve plate and when full metal-to-metal contact exists between the piston sleeve and valve plate.
Figure 5:
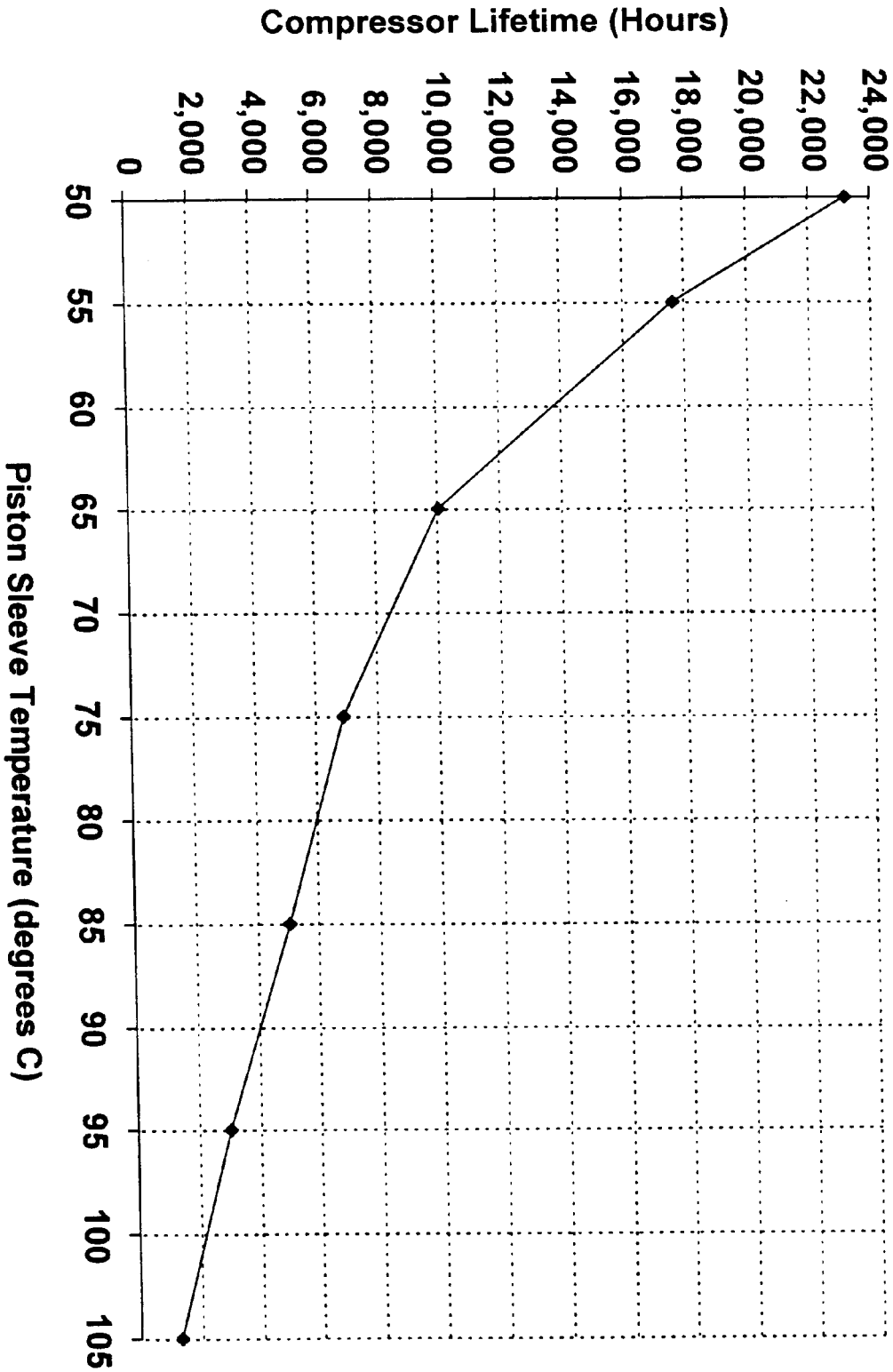
FIG. 5 illustrates the estimated lifetime of a compressor with respect to the temperature of the piston sleeve.

The advantages of utilizing a thermal-insulating barrier disposal between the valve plate and compressor head is exhibited in FIGS. 4 and 5. FIG. 4 illustrates the results of tests measuring the temperature of piston sleeve 18 when the thermal-insulating barrier was present and when it was absent. As can be shown in FIG. 4, the average sleeve temperature decreased approximately four point nine degrees Celsius when the thermal-insulating barrier was utilized (Note that the ambient temperature was one point degree higher during the test when utilizing a thermal-insulating barrier.) For this test, the thermal-insulating barrier was comprised of Delrin.

FIG. 5 illustrates the expected life of a compressor and a cup seal with respect to its relationship to the temperature of the piston sleeve. The compressor was Model Number 2639CE44 manufactured by Thomas Industries of Shebogan Wis. having a cup seal which is generally made from Teflon™. The test were run at fifteen psig continuous. As is evidenced in FIG. 5, the lifetime of the compressor is greatly enhanced when the temperature of the piston sleeve is lowered. When conducting the test as illustrated in FIG. 4, the average temperature of the piston sleeve is reduced from approximately sixty-eight degrees Celsius to sixty-two degrees Celsius. As noted in FIG. 5, the expected lifetime of the compressor having an average piston sleeve temperature of sixty-eight degrees Celsius is approximately eight thousand five hundred hours. Whereas the expected lifetime of the compressor having a piston sleeve temperature of sixty two degrees Celsius is approximately twelve thousand hours. Consequently, as is evidenced by FIG. 4 and FIG. 5, piston assembly A having thermal-insulating barrier 20 disposed between piston sleeve 18 and the valve plate groove 24 would produce benefits of increasing the piston lifetime by three thousand hours or approximately thirty-three percent.

Thus, it has been shown to be advantageous to utilize a thermal-insulating barrier in a hard joint assembly. When the thermal-insulating barrier is disposed between the valve plate and the piston sleeve, heat flow from the compressor head is reduced, reducing the temperature of the piston sleeve and thus the temperature of the cup seal which extends the life of the cup seal and ultimately the life of the compressor. Further, by providing generally flat surface contacts between the valve plate groove, the thermal-insulating barrier, and the piston sleeve, the wearing movement found in soft joint designs is eliminated adding to the durability and thus the life of the compressor.

While a preferred embodiment of the invention has been described using specific terms, such description is for illustrative purposes only, and it is to be understood that changes and variations may be made without departing from the spirit or scope of the following claims.

What is claimed is:

1. A piston assembly for a standard compressor, said piston assembly comprising:

a piston sleeve having an interior wall;

a piston carried within said piston sleeve;

a cup seal carried by said piston which engages said interior wall of said piston sleeve;

a valve plate including a groove having a top surface and lateral side surfaces matingly adapted to rigidly receive said piston sleeve; and a firm thermal-insulating barrier disposed within said groove between said valve plate and said piston sleeve for reducing the heat flow from said valve plate to said piston sleeve.

2. The piston assembly of claim 1 wherein said thermal-insulating barrier has a generally flat surface area and said piston sleeve includes a flat top face portion and an outer surface for abutting said thermal-insulating barrier thereby forming a firm engagement within said groove.

3. The piston assembly of claim 1 wherein said thermal-insulating barrier isolates said piston sleeve from said valve plate.

4. The piston assembly of claim 1 wherein said thermal-insulating barrier has thermal-insulating properties sufficient to reduce the temperature of said piston sleeve by at least five percent with respect to a similar piston assembly without a thermal-insulating barrier.

5. The piston assembly of claim 1 wherein said thermal-insulating barrier is comprised of a Teflon™ material.

6. The piston assembly of claim 1 wherein said thermal-insulating barrier is comprised of a generally non-resilient material.

7. The piston assembly of claim 1 wherein said thermal-insulating barrier is comprised of a ceramic material.

8. A piston assembly for a standard compressor, said piston assembly comprising:

a piston sleeve having an interior wall and including a top flat face portion and an outer surface;

a piston carried within said piston sleeve;

a cup seal carried by said piston engaging said interior wall of said piston sleeve;

a valve plate having a groove for rigidly receiving said piston sleeve, said groove including a flat top surface and lateral side surfaces;

a thermal-insulating barrier received in said groove, said thermal-insulating barrier including a generally flat top surface abutting said flat top surface of said groove and a generally flat bottom surface for abutting said flat top face portion of said piston sleeve, thereby facilitating the support of said piston sleeve within said groove; and said thermal-insulating barrier having thermal-insulating properties for effectively reducing the temperature of said piston sleeve at least five percent with respect to a similar piston assembly without a thermal-insulating barrier.

9. The piston assembly of claim 8 wherein an o-ring is disposed between said outer surface of said piston sleeve and said valve plate, thereby forming a pressure seal.

10. The piston assembly of claim 8 wherein said thermal-insulating barrier isolates said piston sleeve from said valve plate.

11. A piston assembly for a standard compressor, said piston assembly comprising:

a piston sleeve having an interior wall, a piston carried within said piston sleeve;

a cup seal carried by said piston which engages said interior wall of said piston sleeve;

a valve plate matingly adapted to rigidly receive said piston sleeve;

a first firm thermal-insulating barrier disposed between said valve plate and said piston sleeve for reducing the heat flow from said valve plate to said piston sleeve;

a compressor head disposed on top of said valve plate; and a second thermal-insulating barrier disposed between said valve plate and said compressor head.

12. A piston assembly having a hard joint wherein the clearance volume between the top of a piston head and a valve plate is generally fixed when the piston is at top dead center, said pressurization of said piston assembly being achieved by utilizing an o-ring disposed on the outer diameter of a piston sleeve, said piston assembly comprising:

a piston sleeve having an interior wall and a top portion;

a piston having a piston head carried within said piston sleeve;

a cup seal carried by said piston which engages said interior wall of said piston sleeve;

a valve plate abutting said top portion of said piston sleeve; and a firm non-compressible thermal-insulating barrier disposed between said valve plate and said piston sleeve for reducing the heat flow from said valve plate to said piston sleeve;

whereby the firm non-compressible thermal-insulating barrier is not compressed by the valve plate abutting the top portion of said piston sleeve thereby defining a hard joint assembly wherein the clearance volume between the top portion of the piston head and the valve plate is generally fixed when the piston head is at top dead center.

* * * * *